United States Patent [19]

Sly

[11] 4,064,825

[45] Dec. 27, 1977

[54] ALARM DEVICE FOR A CAMPSITE

[76] Inventor: Steve R. Sly, 828 Vanardol, Clarkston, Wash. 99403

[21] Appl. No.: 722,784

[22] Filed: Sept. 13, 1976

[51] Int. Cl.[2] ..... G08B 13/12

[52] U.S. Cl. ..... 116/81; 116/83

[58] Field of Search ..... 116/81, 22 A, 83, 77, 116/78, 94, 67 R, 23

[56] References Cited

U.S. PATENT DOCUMENTS

| | | | |
|---|---|---|---|
| 1,434,132 | 10/1922 | McDonald | 116/81 |
| 1,633,361 | 6/1927 | Bryant | 116/81 |
| 3,071,104 | 1/1963 | McCandlish | 116/83 X |
| 3,443,546 | 5/1969 | Couey | 116/81 |

FOREIGN PATENT DOCUMENTS

| | | | |
|---|---|---|---|
| 76,753 | 1917 | Switzerland | 116/81 |

*Primary Examiner*—Daniel M. Yasich

[57] ABSTRACT

At least one plastic tube, is supported within the campsite ground by a double pointed support spike. On the interior of the tube of the device, is a gravity activated weight, which is supported upon a trip pin, which is slideable transversely through the tube, the pin having attached, a cord, which when struck by an intruder, will cause the trip pin to release the weight, which will strike an explosive primer, so as to alert the camper to the intruder's presence in the campsite.

1 Claim, 3 Drawing Figures

ALARM DEVICE FOR A CAMPSITE

This invention relates to explosive devices, and more particularly, to an alarm device for a campsite.

It is therefore the principal object of this invention to provide an alarm device for a campsite, which will use explosive primer means, to emit a loud noise, when an intruder enters the perimeter of the campsite.

Another object of this invention is to provide an alarm device for a campsite of the type described, which will be particularly adaptable for alerting the camper, and frightening off a bear, or the like.

A still further object of this invention is to provide an alarm device, of the type described, which will be of such structure, so as to contain all of the components therein, when stored.

Other objects of the invention are to provide an alarm device for a campsite, which is simple in design, inexpensive to manufacture, rugged in construction, easy to use and efficient in operation.

These and other objects will be readily evident upon a study of the following specification, and the accompanying drawing, wherein.

Figure 2:
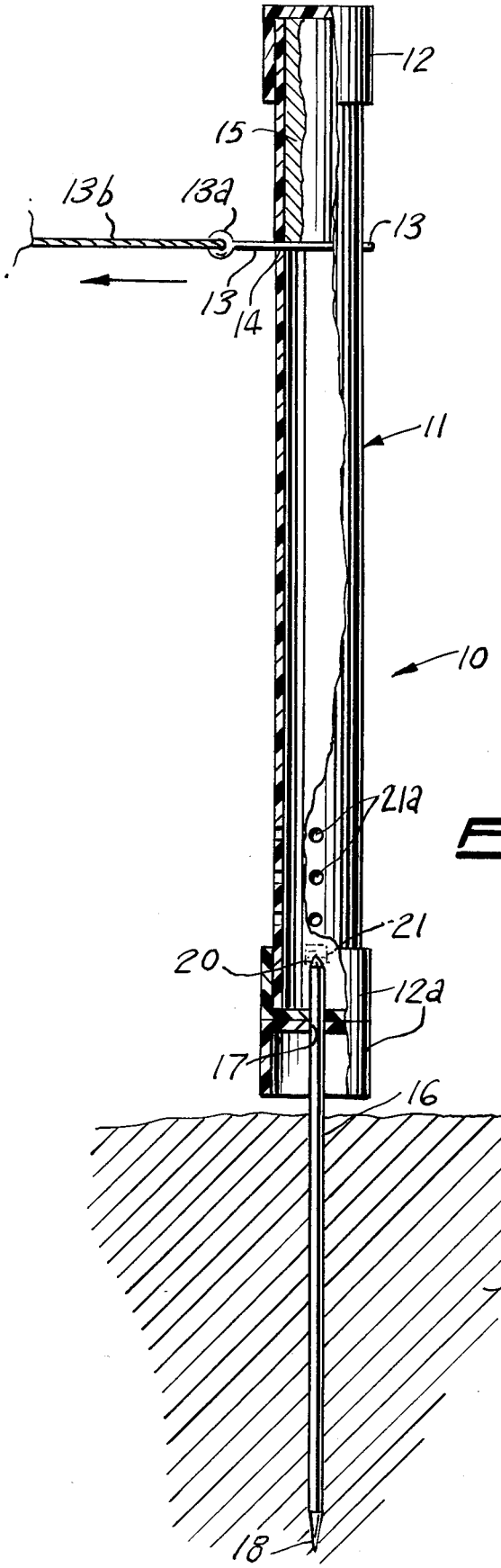
FIG. 2 is an enlarged side view of an alarm device, for campsites comprising the invention, shown partly broken away, and illustrates the explosive primer or percussion cap, in phantom lines.
Figure 1:
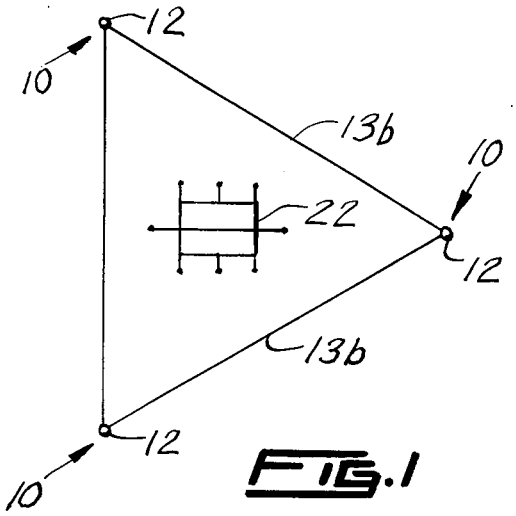
FIG. 1 is a top plan view of a campsite, showing three of the alarm devices for a campsite being used to encompass the area around a camp tent.

According to this invention, an alarm device for a campsite 10 is shown to consist of a hollow plastic tube 11, of cylindrical configuration, having a cap 12, of plastic, secured to one end. A pair of similar plastic caps **12*a* are fixedly secured, back to back, by suitable adhesive, and one of the caps 12*a* is frictionally received on the lower end of tube 11. When storing, one of the caps 12*a* having the spike 16, extending therefrom, is reversed, so as to enter the spike 16 into the tube 11. A trip pin 13 is slideably and freely received within transverse opening 14, of tube 11, near its upper extremity. Trip pin 13 is provided with an eye 13*a*, which receives cord 13*b*, and, as illustrated in FIG. 1 of the drawing, three of the alarm devices for campsites 10 are interconnected by cord 13*b***, for a purpose which hereinafter will be described.

Pin 13 supports the cylindrical weight 15 in the upper end of tube 11, so as to prevent it from descending by gravity means, until cord **13*b* is struck by an intruder. A spike 16 is fixedly secured within the aligned openings 17 of caps 12*a* and spike 16 is provided with a pointed end 18, which enables it to be easily inserted into the ground 19. The opposite end of spike 16 is provided with a pointed end 20, upon which is placed an explosive primer 21, the pointed end 20, of spike 16, serving as firing pin means. When the cord 13*b* is struck, or disturbed by an intruder entering the area around the camp tent 22, the trip pin 13 will slide free of the transverse opening 14 of tube 11. When this occurs, the weight 15 will immediately descend, thus striking the primer 21 against the pointed end 20, which will cause a loud report, the gases and noise being expelled from the plurality of spaced apart openings 21*a***.

Figure 3:
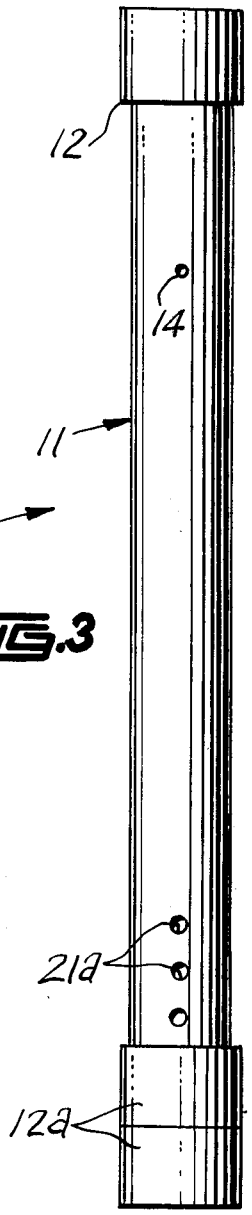
FIG. 3 is a vertical view of the alarm device for a composite, shown packed for storage, the device being shown in elevation.

As will be seen in FIG. 3 of the drawing, the alarm device 10 for a campsite is self contained for storage, the caps **12*a* being reversed, so that the spike 16 will be entered into the tube 11, along with primers 21, tip end 13, and cord 13*b***.

While various changes may be made in the detail construction, it is understood that such changes will be within the spirit and scope of the present invention, as is defined by the appended claims.

What I claim is:

1. An alarm device for a campsite, comprising a plurality of spaced apart tubes, which are placed so as to encompass the campsite, a pair of caps fixedly secured at their end walls to each other, one each of said pair of caps being removably received on one end of said tubes, and a spike, pointed at each end, is fixedly secured within said end walls on the longitudinal axis of each of said pair of caps, one end of said spike being entered into the ground and the other end serving as support and firing pin means for a primer within each of said tubes, and a trip pin is slidably and removably received transversely through an opening near the upper end of said tubes, said trip pins each being secured to an end of a cord on the exterior of said tubes, the opposite end being tied to the outer periphery of the adjacent tube of the plurality of said tubes, and said trip pin abuts against and supports a gravity actuated weight in said tubes until an intruder strikes said cord of said trip pin, said trip pin being removed from the support position of said gravity actuated weight by the cord being pulled by the intruder striking said cord, and said gravity actuated weight descends downwards in said tube and, by inertia means, forcibly urges said primer against the pointed end of said spike within said tube, thus firing said primer, the gases of the explosive report of said primer being discharged through a plurality of radially spaced apart ports through the wall of said tube, which will alert the camper, and a cap is fixedly secured to the upper end of each of said tubes to prevent precipitation from entering the said tubes and said caps fixedly secured to the upper end of each of said tubes, in conjunction with said pair of caps, provides storage means for said gravity actuated weight, said trip pin, said cord and a plurality of said primers when entered into said tubes, and said pair of caps when inverted and replaced on said tube will enclose the portion of said spike within one tube, that is normally entered into the ground.

* * * * *